United States Patent [19]

Litvak et al.

[11] 4,153,521

[45] May 8, 1979

[54] METHOD OF AUTOMATIC CONTROL AND OPTIMIZATION OF ELECTRODEPOSITION CONDITIONS

[76] Inventors: Rafael S. Litvak, ulitsa Kafanova-Titova, 8, kv. 103, Tashkent; Georgy G. Rannev, ulitsa Moskovskaya, 2, korpus 1, kv. 165, Krasnodar; Shulim A. Anash, Chilanzar, kvartal 14, 3, kv. 39; Larisa P. Kim, Chilanzar, 10 kvartal, 38, kv. 17, both of Tashkent; Alexandr I. Pen-Chen-Sek, ulitsa Furkata, 7-17; Gennady E. Borkov, ulitsa Gastello, 24-8, both of Almalyk Tashkentskoi oblasti; Anatoly E. Nikiforov, prospekt 50 let Oktyabrya, 13-24, Almalyk Tashkentskoi oblasti; Vladimir G. Shutchenko, ulitsa Ostrovskogo, 2, kv. 82, Chelyabinsk; Mikhail M. Tabachnikov, ulitsa Sverdlova, 15, Tashkent, all of U.S.S.R.

[21] Appl. No.: 822,050

[22] Filed: Aug. 5, 1977

[51] Int. Cl.[2] ..... C25C 1/00; C25C 7/06; C25D 21/12

[52] U.S. Cl. ..... 204/105 R; 204/1 T; 204/231

[58] Field of Search ..... 204/105 R, 195 C, 1 C, 204/1 T, 231, 237, 45 R

[56] References Cited

U.S. PATENT DOCUMENTS

| | | | |
|---|---|---|---|
| 2,584,816 | 2/1952 | Sands | 204/231 |
| 3,067,123 | 12/1962 | Huber | 204/231 |
| 3,072,557 | 1/1963 | Mandroian et al. | 204/231 |
| 3,331,021 | 7/1967 | Marsh et al. | 204/1 C |
| 3,406,101 | 10/1968 | Kilpatrick | 204/1 C |
| 3,766,042 | 10/1973 | Wilson | 204/195 C |

*Primary Examiner*—T. M. Tufariello
*Attorney, Agent, or Firm*—J. Harold Nissen

[57] ABSTRACT

Disclosure is made of a method of automatic control and optimization of electrodeposition conditions through galvanostatic deposition of test deposits of metal in the course of continuous circulation of electrolyte, whereby the test deposits of metal are produced from both good and foul electrolyte, whereupon the deposits are dissolved at the same points of the process. The difference between the time intervals of complete of these deposits is then found and is indicative of the intensity of electrolysis, current efficiency, as well as overall efficiency of the process.

The proposed method is carried out with the aid of a device comprising units for measuring and corrosivity of the electrolyte, placed at the input and output of a series of baths, which units apply a signal to a computing unit, whereto there is also applied a signal from a unit for measuring the wattage consumed in the course of electrolysis, the signal from the computing unit being applied to an actuator which correspondingly changes the initial parameters of the process. Each means for measuring the corrosivity of the electrolyte is a three-electrode cell comprising a working electrode, an auxiliary electrode and a measuring electrode, which are connected to a current and time setting unit via a switch which ensures the flow of deposition and dissolution current between the working and auxiliary electrodes, as well as dissolution in the absence of current. The unit for measuring the corrosivity of the electrolyte, which is placed at the output of the series of baths, is coupled to the computing unit via a delay unit.

6 Claims, 6 Drawing Figures

METHOD OF AUTOMATIC CONTROL AND OPTIMIZATION OF ELECTRODEPOSITION CONDITIONS

The present invention relates to hydrometallurgy and, more particularly, to a method of automatic control and optimization of electrodeposition conditions and a device for effecting this method.

The invention can be used to advantage for optimizing control of electroextraction of such metals as zinc, cadmium, antimony, nickel and some others from aqueous solutions of their salts.

The invention is used to the best advantage in the case of electrowinning metals from solutions containing harmful impurities which reduce the current efficiency, as well as the overall efficiency of the process. The invention also displays itself to the best advantage in cases of uncontrolled noise.

The proposed method of automatic control and optimization of electrodeposition conditions and the device for carrying out this method ensure a maximum current efficiency with a varying ion composition of the electrolyte and unstable technological parameters.

In the course of electrolysis, the corrosivity of the electrolyte varies with respect to test deposits of metal produced from the same electrolyte. Such fluctuations are due to changes in the physico-chemical properties of the electrolyte in the course of electrolysis, which changes are stoichiometrically related to the amount of extracted metal. These considerations gave rise to the idea of measuring the depth and efficiency of electrolysis with reference to changes in the corrosivity of the electrolyte.

There is known a device for monitoring the current efficiency and metal deposition rate in a plating bath (cf. USSR Inventor's Certificate No. 234,714), comprising a measuring instrument and a sensor constructed as a transformer to whose secondary winding is connected a wire which is also connected to the cathode circuit of the bath. The wire's resistance changes in proportion to the thickness of the metal layer deposited on the wire.

The foregoing device is not accurate enough, which is due to the fact that the local deposition of metal on the wire is not indicative of the current efficiency and the overall efficiency of the process, keeping in mind the fact that the bath is sensitive to the presence of foreign bodies, such as the wire in question. The sensitive element of the device, i.e., the wire, cannot simulate the cathode. Besides, when introduced into the bath, the wire affects the electric field distribution between the anode and cathode, since it acts as a concentrator of lines of force.

Centralized supply of electrolyte to a great number of baths makes it more difficult to collect information on the metal deposition rate in each bath and affects the accuracy of measurements.

There is known a device for weighing deposits of zinc in the course of electrodeposition (cf. the journal "Tsvetnye metally" /"Non-Ferrous Metals"/, No. 6, 1974, an article by G. M. Guselnikov), which comprises wire strain gauges arranged in an electrolytic bath under each of the cathodes, whereon metal is deposited.

In industrial conditions, the device of the latter type cannot ensure the required accuracy of measuring the output and current efficiency because of a great number of sensors, since there is a sensor under each cathode in an electrolytic bath. The use of this device calls for a more complicated bath design. The metal deposition rate is measured separately in each bath, which requires specific process conditions for each bath. However, the latter requirement cannot be complied with under the conditions of centralized supply of electrolyte. Thus far, there is no information on the industrial application of the device in question.

An electrolysis shop is currently regarded as a single reaction vessel, whereas the process of electrolysis is monitored and controlled with reference to the electrochemical properties of the electrolyte supplied for the process.

The electrochemical quality index is determined gasometrically. It may be derived either from the amount of gas released in the course of a test process (cf. N. I. Mikhailov, "Opredeleniye vykhoda electroosazhdyonnykh metallov po toku gazometricheskim sposobom" /"Gasometric Evaluation of Current Efficiency"/, "Zavodskaya laboratoria" /"Industrial Laboratory"/, No. 10, 1959; M. A. Fishman et al., "Avtomatichesky control kachestva tsinkovogo electrolyta" /"Automatic Quality Evaluation of Zinc Electrolyte"/, "Tsvetnye metally" /"Non-Ferrous Metals"/, No. 2, 1963; R. C. Korly, G. M. Brannen, "The Construction and Operation of a Meter for Measuring the Quality of Zinc Electrolytes," Techn. Bull. of Dep. Energy, Mines and Resources, Mines Branch, No. 160, Ottawa, 1972; Japanese Pat. No. 49-15530, Cl. 10 M 23, published Apr. 16, 1975), or from the time of anode dissolution of a test deposit of metal (cf. USSR Inventor's Certificate No. 127,067; Controle automatique des impuretés dans les bains d'électrolyse du zinc, le four électr. et inds. électrochim., 1966, 71, numéro 91.

The electrochemical quality index characterizes the purity of the electrolyte supplied for the process and makes it possible to forecast the efficiency of the process to the extent to which the efficiency is dependent upon the quality of the electrolyte used in the process. Qualitative evaluation of the electrolyte is a sine qua non condition of normal operation, yet it is insufficient to forecast the actual output and current efficiency, since it does not take into account such parameters of the process as the condition of baths and electrodes, electrical parameters, circulation rate, etc. Besides, the use of the gasometric and electrochemical methods and devices for carrying out these methods requires thorough preparation of the electrolyte in order to stabilize the effects of the acid constituents in the course of test electrolysis.

There are known efficiency evaluation techniques, whereby the results are derived from the physical properties of the electrolyte, such as density, conductivity, etc. (cf. James L. Owings, "Instrumentation and Control at the Great Falls Zinc Plant," Unit Processes Hydrometallurgy, New York-London, 1964; Conductivity Meter Has Several Functions, Controls and Instrumentation, 1972, XI, vol. 12, No. 11; V. L. Korobkov et al., "Avtomatichesky Analizator tsinkovogo electrolyta" /"Automatic Zinc Electrolyte Analyzer"/, Transactions of VNIITSVETMET, Ust-Kamenogorsk, No. 10, 1967).

In this case the parameter being measured, such as density, conductivity, the concentration of some or other admixture, etc., is regarded as a parameter which determines the entire process.

However, a chosen parameter invariably produces a multiple effect; as a result, the forecasting is wrong.

Forecasting with reference to physical properties is as imperfect as forecasting based on the electrochemical properties of the solution. In addition, the sensitive elements of density, conductivity and other sensors are either damaged by aggressive products of electrolysis or covered with slime, which affects the reliability of the sensors, as well as the accuracy of measurements. At present, there are no reliable and effective sensors to continuously measure the output and current efficiency; as a result, the process is controlled empirically, without regard for process parameters; in fact, the control boils down to solely acting upon the parameters of the electrolyte supplied for the process, such as the temperature, flow rate, ion composition, etc. (cf. USSR Inventor's Certificate No. 258,688, Cl. G 05 d 11/02, 1972; USSR Inventor's Certificate No. 367,172, Cl. C 22 d/1/22; 1973; U.K. Patent Nos. 1,274,892, Cl. G 3R, 1972, No. 1,270,398, Cl. C7 B, 1972, No. 1,260,162, Cl. G3 R, 1972; U.S. Pat. Nos. 3,632,488 and 3,712,857, Cl. 204–267; No. 3,734,848, Cl. 204–220, 1973; No. 3,751,355, Cl. 204–228, 1973; French Pat. Nos. 2,119,811, Cl. G 01 b 11/00, 1972, 2, 172,518 (47), 2,176,275 (47), Cl. G 05 b 11/00, 1973).

In all the foregoing cases it is impossible to ensure optimum process conditions, because the process of electrolysis involves a number of different factors. It is impossible to find the optimum process conditions without objective information on the response of the process to some or other action. Likewise, it is pointless to stabilize some of the process parameters, while others remain uncontrolled.

It is an object of the present invention to eliminate the above disadvantages.

It is another object of the invention to provide a method of automatic control and optimization of electrodeposition conditions and a device for carrying out this method, which would continuously supply information on the actual output, and ensure optimum process conditions and a maximum current efficiency.

The foregoing objects are attained by providing a method of automatic control and optimization of electrodeposition conditions through galvanostatic deposition of test deposits of metal in the course of continuous circulation of electrolyte, which is characterized, according to the invention, by that the test deposits are produced from both fresh and foul electrolyte, whereupon the test deposits are completely dissolved at the same points of the process, which is followed by finding the difference between the time intervals of complete dissolution of these deposits, which difference is indicative of the intensity of electrolysis, current efficiency, and overall efficiency of the process.

According to the invention, it is preferable that the dissolution of test deposits of metal should be carried out under the conditions of alternating galvanic and currentless dissolution, which ensures a high accuracy of the proposed method. It is also advisable that galvanic and currentless dissolution should alternate so that the dissolution of the test deposits is completed during the galvanic period.

It is further advisable, in accordance with the invention, that the difference between the time intervals of complete dissolution of test deposits should be used as a reference value to control the intensity of electrolysis and the efficiency of the process by changing the ratio between the amount of fresh electrolyte supplied for the process and that of foul electrolyte, as well as the temperature of the fresh electrolyte, and thus ensure optimum process conditions.

The foregoing objects of the present invention are also attained by providing a device for carrying out the proposed method of automatic control and optimization of electrodeposition conditions, comprising a unit for measuring the corrosivity of the electrolyte, placed at the input of a series of baths, which unit sends a signal to a computing unit, whereto there is also applied a signal from a unit for measuring the wattage consumed in the course of electrolysis, the computing unit sending a signal to an actuator which correspondingly acts upon the input parameters of the process, the unit for measuring the corrosivity of the electrolyte being constructed as a three-electrode cell comprising a working electrode, an auxiliary electrode and a measuring electrode which are connected to a current and time setting unit via a switch which ensures the flow of current between the working and auxiliary electrodes, as well as currentless dissolution conditions, the device further including, according to the invention, a unit for measuring the corrosivity of the electrolyte, placed at the output of the series of baths and coupled to the computing unit.

The proposed device makes it possible to determine actual instantaneous efficiency values of the electrodeposition process. These values are state variables of the process and characterize the effectiveness of the process. They are analyzed by an optimizer and maintained within an optimum range. The device of the present invention also makes it possible to conduct running checks and record efficiency coordinates. If the supply of standard solutions is accompanied by reduced efficiency, this is an indication of the necessity to take urgent steps to improve the condition of the bath and electrode equipment.

The use of the proposed device raises the current efficiency by an average of 2 percent, as compared to the existing levels, and makes it possible to perform running checks of the electrodeposition efficiency.

Other objects and advantages of the present invention will become more apparent from the following detailed description of preferred embodiments thereof to be read in conjunction with the accompanying drawings, wherein.

Figure 1:
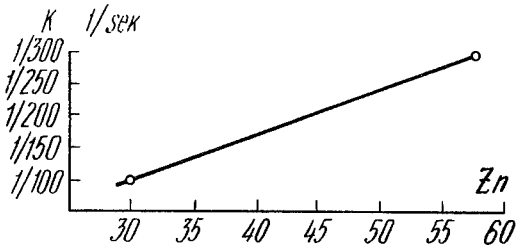
FIG. 1 is a graph, in which corrosivity of zinc electrolyte is plotted against a test deposit of zinc with a constant concentration of sulphuric acid and a varying zinc concentration.

At this point, it is worthwhile to explain some terms which crop up in the text of this disclosure.

Corrosivity of electrolyte means the capacity of electrolyte to dissolve metal placed therein; corrosivity is characterized by the dissolution rate of metal and is measured in terms of mass units dissolved during a certain period of time (g/sec). The present disclosure lists examples, in which a deposit is specified in terms of the deposition current and time of deposition; the deposit is then fully dissolved, in which case corrosivity is measured with reference to the period of time it takes to completely dissolve the deposit (I/sec).

A state variable of the process is the basic parameter characterizing the efficiency and effectiveness of the process. A state variable serves as a criterion for assessing process conditions. In the case of electrolysis of metals, the state variable is the efficiency of the process in the presence of certain limiting constants, such as a constant current density, a constant flow rate of electrolyte, and a constant working volume of the bath.

The proposed method of automatic control and optimization of electrodeposition conditions is essentially as follows. In the electrolyte, which is continuously supplied and discharged in the course of the process, there are placed two three-electrode cells, each comprising a working electrode, whereon a test layer of metal is deposited, an auxiliary electrode, which produces a flow of current between the working electrode and a galvanostatic current source in order to deposit and dissolve the metal deposit, and a measuring electrode which registers deposition and dissolution potentials across the working electrode, as well as a moment of complete dissolution of the metal from working electrode. The use of the measuring electrode is due to the necessity of stable registration of said potentials. In cases of less stringent requirements imposed upon the stability of registration, such potentials can be measured between the working and auxiliary electrodes, although this affects the accuracy of measurements. The foregoing operations are followed by test electrolysis which is carried out over a limited period of time in both electrolyzers. The test electrolysis involves the deposition of test layers of metal on the surface of the working electrodes with subsequent dissolution of the metal deposits. As this takes place, there are measured the deposition time and the deposition current density, as well as the time intervals of dissolution of the test deposits in the fresh and spent electrolyte. The corrosivity of the electrolyte changes with respect to the test deposit as a result of the electroextraction of metal and the formation of different ions, so the dissolution time of the test deposits also changes; the difference between the time intervals of dissolution of these deposits is a quantitative indication of the intensity of electrolysis, whereas, taking into account the wattage consumed in the course of the electrolysis, it is also indicative of the efficiency of the process.

The proposed method of automatic control and optimization of electrodeposition conditions will be explained with reference to the relationship of the corrosivity of zinc electrolyte ($ZnSO_4$—$H_2O$—$H_2SO_4$) versus the change in its ion composition.

The data were obtained in laboratory conditions with the use commercial electrolyte in the course of the experiments. The concentration of zinc varied between 30 and 60 g/l, whereas the acid concentration was maintained constant and amounted to 120 g/l. The acid concentration was then changed within the range of 100 to 150 g/l, while the zinc concentration remained constant and was equal to 40 g/l. There were also established data on the change in the corrosivity of the electrolyte with respect to the test zinc deposit with stoichiometric changes in the zinc and acid concentrations within the range of (115/65 ÷ 169/29) $H_2SO_4$/Zn g/l.

Figure 2:
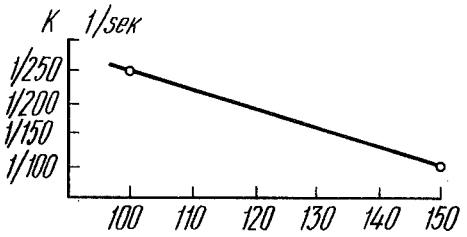
FIG. 2 is a graph, in which corrosivity of zinc electrolyte is plotted against a test deposit of zinc with a constant zinc concentration and a varying concentration of sulphuric acid.

As is seen from the graph of FIG. 1, a reduced zinc concentration results in an increased corrosivity of the electrolyte; the graph of FIG. 2 shows that an increase in the sulphuric acid concentration also increases the corrosivity of the electrolyte. In case of a simultaneous change in the concentrations of zinc and sulphuric acid, the corrosivity of zinc electrolyte is expressed as follows:

$$K = b_o + b_1(\mathrm{Zn}) - b_2(\mathrm{H_2SO_4}) \quad (1),$$

where K is the corrosivity of the electrolyte;

(Zn) is the zinc concentration, g/l;

($H_2SO_4$) is the sulphuric acid concentration, g/l; and $b_o$, $b_1$ and $b_2$ are constant coefficients.

The corrosivity of the fresh electrolyte is expressed like this:

$$K^{(o)} = b_o + b_1(\mathrm{Zn}^{(o)}) - b_2(\mathrm{H_2SO_4}^{(o)}) \quad (2),$$

where ($Zn^{(o)}$) is the concentration of zinc in the fresh electrolyte; and ($H_2SO_4^{(o)}$) is the concentration of sulphuric acid in the fresh electrolyte.

The corrosivity of the foul electrolyte removed from the process is expressed as follows:

$$K^{(x)} = b_o + b_1(\mathrm{Zn}^{(x)}) - b_2(\mathrm{H_2SO_4}^{(x)}) \quad (3),$$

where ($Zn^{(x)}$) is the concentration of zinc in the spent electrolyte; and ($H_2SO_4^{(x)}$) is the concentration of sulphuric acid in the spent electrolyte.

(3) can be expressed like this:

$$K^{(o)} + \Delta K = b_o + b_1(\mathrm{Zn}^{(o)} - \Delta\mathrm{Zn}) - b_2(\mathrm{H_2SO_4}^{(o)} + \Delta\mathrm{H_2SO_4}) \quad (4)$$

where $\Delta K$ — is the change in the corrosivity of zinc electrolyte;

$\Delta Zn$ — is the change in the concentration of zinc; and $\Delta H_2SO_4$ — is the change in the concentration of sulphuric acid.

Here is the result of subtracting (2) from (4):

$$\Delta K = -b_1 \cdot \Delta\mathrm{Zn} - b_2 \cdot \Delta\mathrm{H_2SO_4} \quad (5)$$

It is known from the equation of the electrochemical reaction that a change in the zinc concentration is stoichiometrically related to a change in the concentration of acid, the stoichiometric coefficient being equal to 1.5; this means that 1.5 g of sulphuric acid is produced per 1 g of zinc extracted in the process. Hence, $$\Delta K = -\Delta\mathrm{Zn}(b_1 + 1.5b_2) \quad (6)$$

Figure 3:
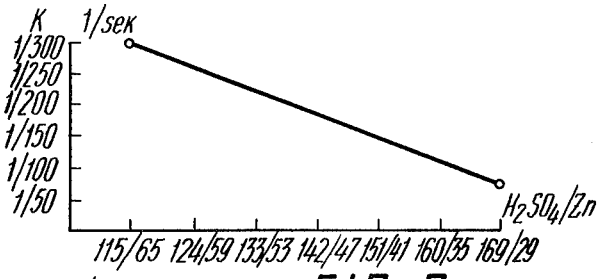
FIG. 3 is a graph, in which corrosivity of zinc electrolyte is plotted against a test deposit of zinc for the case when the concentrations of zinc and sulphuric acid vary simultaneously and in stoichiometric relationship.

It is clear that a change in the corrosivity of the electrolyte characterizes the material balance of the electroextraction process with reference to zinc. As is seen from FIGS. 1 and 2, the coefficients $b_1$ and $b_2$ are constant due to a linear dependence of the corrosivity of the electrolyte upon respective concentrations. This fact is also corroborated by a graph showing the relationship of the corrosivity of the electrolyte versus simultaneous stoichiometric changes in the concentrations of zinc and sulphuric acid (FIG. 3). The dependence is linear throughout the range within which the concentrations are changed.

Consider now some examples of changing the corrosivity of zinc electrolyte.

The working electrode is a disc of glass graphite with a diameter of 8 mm; the auxiliary electrode is a carbon rod having 8 mm in diameter and 60 mm in length; the measuring electrode is a calomel half-cell. The deposition time is 60 sec; the deposition current density is 450 a/m$^2$; the dissolution current density is 80 a/m$^2$. The results of measurements with the use of commercial electrolyte are listed in the following table.

Table

| Serial No | Fresh Electrolyte Concentration, g/l Zn | Fresh Electrolyte Concentration, g/l $H_2SO_4$ | Fresh Electrolyte Dissolution time, sec | Foul Electrolyte Concentration, g/l Zn | Foul Electrolyte Concentration, g/l $H_2SO_4$ | Foul Electrolyte Dissolution time, sec | Difference in zinc concentration, g/l | Difference in dissolution time intervals sec |
|---|---|---|---|---|---|---|---|---|
| 1 | 2 | 3 | 4 | 5 | 6 | 7 | 8 | 9 |
| 1 | 50 | 120 | 280 | 40 | 135 | 200 | 10 | 80 |
| 2 | 45 | 130 | 220 | 35 | 145 | 140 | 10 | 80 |
| 3 | 50 | 120 | 280 | 42 | 132 | 216 | 8 | 64 |
| 4 | 50 | 120 | 280 | 45 | 127.5 | 240 | 5 | 40 |
| 5 | 50 | 120 | 280 | 50 | 120 | 280 | 0 | 0 |

The table shows (see lines 1 and 2) that with a constant depth of electrolysis, the difference between the time intervals of dissolution of test deposits is constant. As is seen from lines 3 and 4, a reduced intensity of electrolysis reduces the difference in the time intervals. As the intensity of electrolysis is brought to zero (see line 5), i.e., when conditions are reached when zinc is not deposited at all, the difference between the time intervals is zero, which means that the composition of the fresh and foul electrolytes is identical.

To improve the accuracy of the proposed method, the dissolution of test deposits of metal should be carried out under the conditions of alternating galvanic and currentless dissolution by periodically breaking the circuit between the working and auxiliary electrodes, i.e., by alternating periods of dissolution under the action of an external current source with periods of purely chemical dissolution. The accuracy of measurements is improved in this case due to an increase in the corrosivity of the electrolyte, which, in turn, is due to periodic renewal of the dissoluble test deposit surface and intensified dissolution because of the activization of impurities deposited with zinc.

Figure 4:
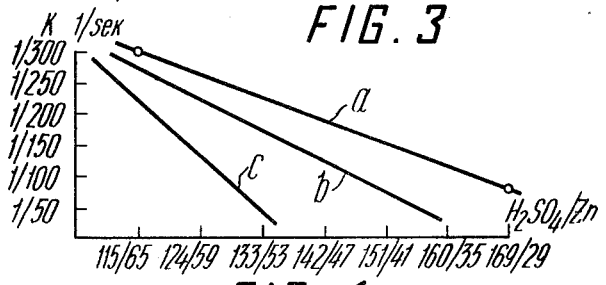
FIG. 4 is a graph, in which corrosivity of zinc electrolyte is plotted against a test deposit of zinc for the case of introducing currentless dissolution periods of different duration and varying the concentrations of zinc and sulphuric acid in stoichiometric relationship.

The graph of FIG. 4 shows the relationship of the corrosivity of the electrolyte against changes in the concentrations of zinc and acid in zinc electrolyte, which concentrations are changed stoichiometrically and with different durations of the currentless dissolution periods. The graph shows an increase in the angle of inclination of the straight lines with an increase in the duration of currentless dissolution periods; the angle of inclination of the straight line "c" is greater, as compared to those of the straight lines "a" and "b." This is indicative of an increased sensitivity to a change in the electrolyte composition and, consequently, an improved accuracy of measurements.

However, if the dissolution of the test deposit is completed during a currentless period, the registration of this moment is impeded due to the continuous change in the potential at the end of the dissolution. On the other hand, in the presence of current supplied from an external source, the end of dissolution is sharply defined and is easy to register. As a result, the dissolution periods are to be alternated so that the dissolution of the test deposits of metal should be completed during a galvanic dissolution period. If one knows the actual range of changes in concentrations and uses the graphs of FIG. 4, it is easy to select the duration of currentless dissolution periods, as well as the mode of alternating periods of dissoluton in the presence and absence of current.

Consider an example of selecting the mode of alternating dissoluton periods in the presence and absence of current.

According to requirements which are to be met to ensure normal operation of electrodes, a change in the concentration of fresh electrolyte is as follows: $Zn_{min}=35$ g/l; $Zn_{max}=60$ g/l. From the graphs of FIG. 4, the duration of currentless dissolution is selected to be equal to 40 sec to cover the entire range of measurements. With a minimum zinc concentration, the dissolution time in the presence of current is 50 sec; thus, the dissolution periods are to be alternated as follows:

1st period: 20 seconds of currentless dissolution;
2nd period: 25 seconds of galvanic dissolution;
3rd period: 20 seconds of currentless dissolution;
4th period: 25 seconds of galvanic dissolution.

Thus, having information on actual electrolysis intensity values, which information is indicative of the efficiency of the process, it is possible to maintain optimum process conditions and ensure a maximum output.

Figure 5:
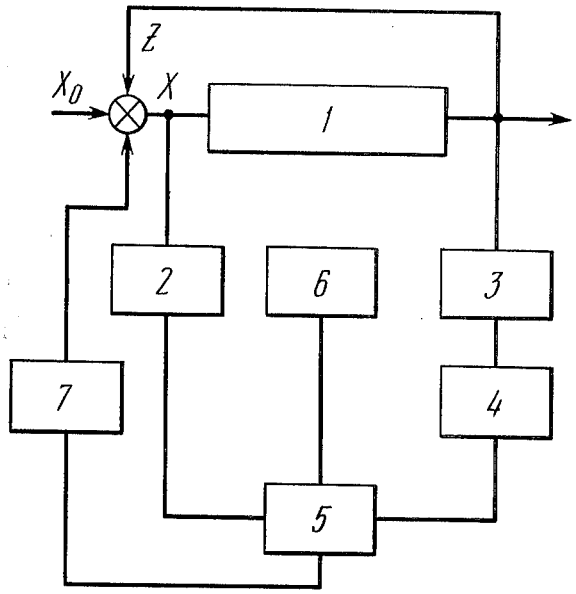
FIG. 5 is a functional diagram of an automatic optimization system to optimize electrodeposition conditions.

FIG. 5 is a functional diagram of the proposed device for carrying out the above method of automatic optimizing control of electrodeposition conditions.

The highlights of the device of this invention are as follows. To the input and output of a series of baths 1 there are respectively connected units 2 and 3 for measuring the corrosivity of fresh and foul electrolyte. Connected to the output of the measuring unit 3 is a delay unit 4 to ensure delayed indication of the unit 3 for measuring the corrosivity of foul electrolyte. The output of the measuring unit 2 and that of the delay unit 4 are connected to a computing unit 5, whereto from a wattage measuring unit 6 there is supplied information on wattage consumed in the course of electrolysis. The output of the computing unit 5 is connected to the input of actuators 7 which can change the input parameters of the process.

According to the proposed method of automatic control and optimization of electrodeposition conditions, the fluctuations in the electrolyte corrosivity should be kept at a maximum. In the dynamic conditions of the process, the following condition is to be met:

$$\frac{d^2K}{dt} = \left[ K^{(o)}(t) - K^{(x)}(t) \cdot (1 - l^{\frac{t}{T}}) \right] \quad (7),$$

where T is the delay time, determined by the bath volume and the mean time, during which the electrolyte is kept in the bath, i.e., T=V/v, where V is the bath volume, and v is the circulation rate of electrolyte.

Actual changes in the electrolyte corrosivity are derived from this formula:

$$\Delta K = \int_o^t \left[ K^{(o)}(t) - K^{(x)}(t) \cdot (\tau - 1^{\frac{t}{T}} \right] dt \quad (8)$$

The formula (8) defines the depth of electrolysis; in order to evaluate the efficiency of the process, one must take into consideration the wattage consumed in the process, so the efficiency of the process is expressed as follows:

$$\Pi = \frac{1}{\Sigma P} \cdot \int_o^t \left[ K^{(o)} \cdot (t) - K^{(x)} \cdot (t)(1 - l^{\frac{t}{T}}) \right] dt \quad (9),$$

where P is the actual wattage consumed in the course of electrolysis; and $\Pi$ is the actual efficiency coordinates.

The proposed method of automatic control and optimization of electrodeposition conditions is carried out as follows. Information on the corrosivity of fresh electrolyte is produced by the measuring unit 2 and sent to the computing unit 5 via the delay unit 4, so that the information on the corrosivity of foul electrolyte is delayed in time. Information on the corrosivity of foul electrolyte is produced by the unit 3 and entered in the unit 5. Also entered in the computing unit 5 is information on running power coorinates, supplied by the wattage measuring unit 6. The computing unit 5 analyzes the information on the actual corrosivity of the fresh and foul electrolyte and wattage consumed in the process and, by using the algorithm of the formula (9), computes the running process efficiency coordinates and stores them in the immediate-access memory. The computing unit 5 acts through the actuators 7 upon the parameters of the fresh electrolyte, the ratio between the amounts of fresh and foul electrolyte used in the process, the temperature of the fresh electrolyte, etc. The computing unit 5 also compares the efficiency levels prior to and after controlling the process; if the efficiency increases, the process is acted upon in the same manner; if the efficiency decreases, the action upon the process is reversed. As a result, a maximum efficiency is constantly maintained, while standard electrolyte is used in the process.

Consider now an example of carrying out the proposed method of automatic control and optimization of electrodeposition conditions with reference to electroextraction of zinc.

(1) The solution to be used in the electrolysis is as follows:

| | |
|---|---|
| zinc concentration, | 50 g/l |
| acid concentration, | 120 g/l |
| temperature, | 32° C. |

-continued

| | |
|---|---|
| current density, | 450 a/m$^2$ |

The dissolution of the test deposit takes 280 sec. The foul electrolyte is as follows:

| | |
|---|---|
| zinc concentration, | 42 g/l |
| acid concentration, | 132 g/l |
| temperature, | 40° C. |
| current density, | 450 a/m$^2$ |

The dissolution of the test deposit takes 216 sec.

The difference between the dissolution time intervals is 64 seconds, which corresponds to the extraction of 8 g/l of zinc from the solution.

(2By an instruction from the computing unit 5, the actuators 7 act upon the temperature and the ratio between the amounts of fresh and foul electrolyte used in the process. As a result, the solution supplied for the electrolysis is as follows:

| | |
|---|---|
| zinc concentration, | 45 g/l |
| acid concentration, | 130 g/l |
| temperature, | 30° C. |
| current density, | 450 a/m$^2$ |
| The dissolution time of the test deposit, | 220 sec. |
| The foul electrolyte is as follows: | |
| zinc concentration, | 35 g/l |
| acid concentration, | 145 g/l |
| temperature, | 38° C. |
| current density, | 450 a/m$^2$ |

The dissolution time of the test deposit, 140 sec.

Now the difference between the dissolution time intervals is 80 sec, which corresponds to the extraction of 10 g/l of zinc from the solution. The efficiency has increased, so the action upon the process is repeated in the same manner.

(3) The solution supplied for the electrolysis is as follows:

| | |
|---|---|
| zinc concentration, | 40 g/l |
| acid concentration, | 140 g/l |
| temperature, | 30° C. |
| current density, | 450 a/m$^2$ |
| The dissolution time of the test deposit, | 180 sec. |
| The foul electrolyte is as follows: | |
| zinc concentration, | 31 g/l |
| acid concentration, | 153,5 g/l |
| temperature, | 38° C. |
| current density, | 450 a/m$^2$ |

The dissolution time of the test deposit, 108 sec.

The difference between the dissolution time intervals is 72 sec, which corresponds to the extraction of 9 g/l of zinc from the solution.

The reduced efficiency resulting from the changes in the parameters of the fresh electrolyte necessitates reversed action upon the input parameters of the process.

Figure 6:
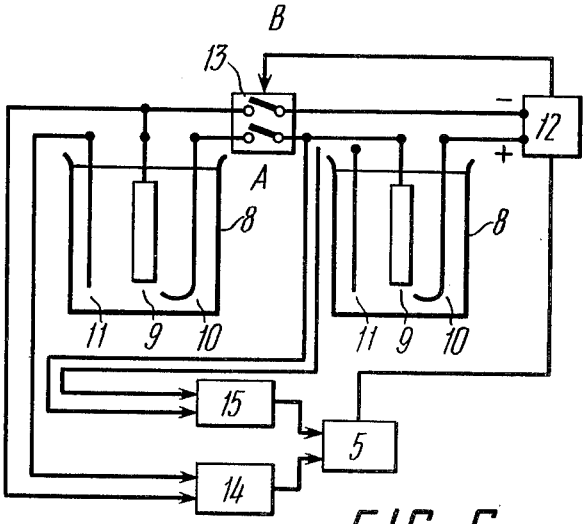
FIG. 6 is a key diagram of a device for automatic optimizing control of electrodeposition conditions.

FIG. 6 is a diagram showing a preferred embodiment of a unit for measuring electrolyte corrosivity, in accordance with the invention. The unit comprises two electrolysis cells 8, each housing working electrodes 9, auxiliary electrodes 10 and measuring electrodes 11.

The working electrodes 9 and auxiliary electrodes 10 and current are connected to a deposition time and deposition current setting unit 12. Deposition time and current are set with the aid of a switch 13. The working electrodes 9 and measuring electrodes 11 are connected to the input of measuring transducers 14 and 15 which covert the time of the presence of a potential of dissolution of test deposits into electric signals. Said signals are applied to the computing unit 5 which determines the change in the electrolyte corrosivity.

The electrolyte corrosivity measuring unit operates as follows. From the deposition time and current setting unit 12, current flows via the switch 13 (position A) between the working electrodes 9 and auxiliary electrodes 10. Upon the completion of a preselected deposition period, the switch 13 breaks the deposition current circuit (position B), which is followed by currentless dissolution of the metal deposit during a preselected period of time. The current from the unit 12 is then reversed; current is now supplied via the switch 13 (position A) to dissolve the test deposit of metal. The time during which the dissolution potential is present between the working electrode 9 and the measuring electrode 11 is registered by the measuring transducers 14 and 15 which apply electric signals, whose value is proportional to the time interval of dissolution of test deposits, through both channels to the computing unit 5. The latter determines the change in the electrolyte corrosivity.

What is claimed is:

1. A method of automatic control and optimization of technological conditions of electrodeposition of metal from electrolyte, comprising the steps of a. electrolytically depositing a test deposit of metal from fresh electrolyte solution being supplied for use in the process, unto a first indicator electrode;

b. electrolytically depositing a test deposit of metal from foul electrolyte being removed from the electrolysis process and unto a second indicator electrode both said test deposit being formed with a predetermined direct current flowing for a predetermined period of time;

c. determining the difference in time for each test deposit to re-dissolve in its respective electrolyte as an index of the extent to which the foul electrolyte has been depleted of metal;

d. comparing the index of the extent of metal depletion with the amount of energy consumed in the process as an efficiency index of the relative efficiency of the process; and e. controlling electrolyte composition and temperature to maintain the efficiency index within predetermined limits.

2. In the method of claim 1, wherein three - electrode measuring electrolyzers are used in the method for measurement in the fresh and foul electrolyte, each electrolyzer including the inert test indicator electrode, a measuring electrode, and an auxiliary electrode, wherein:

a. the step of depositing the test deposit from fresh electrolyte and the step of depositing the test deposit from foul electrolyte each comprising connecting a direct current source and a timer between the auxillary electrode and the indicator electrode to apply the predetermined amount of current thereacross and deposit the test deposit;

b. the step of determining the differences in time for re-dissolution of each test deposit comprising monitoring the potential between the measuring electrode and the indicator electrode to determine when re-dissolution is complete, for each respective electrolyzer submerged in each respective electrolyte.

3. In the method of claim 2, the step of determining difference in time for re-dissolving, further including reversing the polarity of the direct current source employed to deposit each test deposit and applying this reversed polarity direct current source during at least the final portion of the re-dissolving time for each test deposit.

4. In the method of claim 3, the further steps of monitoring the position of each electrolyzer relative to the surface of the electrolyte in which it is submerged to ensure that the electrolyzer is submerged.

5. In the method of claim 3, the further steps of applying the reversed potention during re-dissolving of the test deposit during only predetermined times alternated with times during which re-dissolving takes place without the reversed potential.

6. A method of indexing the extent of electrolytic deposition of metal from fresh to foul electrolyte comprising:

electrolytically extracting a test deposit of metal from both fresh and foul electrolyte; and thereafter determining the time required for each test deposit to re-dissolve in its corresponding electrolyte, the difference in time for the test deposit from fresh electrolyte to re-dissolve in fresh electrolyte and the time for the test deposit from the foul electrolyte to re-dissolve in foul electrolyte being an index of the extent of the electrolytic deposition of metal from the fresh electrolyte.

* * * * *